US005413347A

United States Patent [19]

Prater

[11] Patent Number: 5,413,347

[45] Date of Patent: May 9, 1995

[54] DEVICES FOR HITTING GOLF BALLS WHEN IN CONFINED SPACES

[76] Inventor: Billy G. Prater, R.R. 1 Box 54, Dover Plains, Wyo. 12522

[21] Appl. No.: 160,217

[22] Filed: Dec. 2, 1993

[51] Int. Cl.[6] ..... A63B 69/36

[52] U.S. Cl. ..... 273/200 A; 273/200 R; 273/185 C

[58] Field of Search ..... 273/200 R, 200 A, 35 R, 273/185 C, 185 D, 184 R, 184 B, 26 E, 26 EA

[56] References Cited

U.S. PATENT DOCUMENTS

| | | | |
|---|---|---|---|
| 2,680,022 | 6/1954 | Walden | 273/200 A |
| 3,042,401 | 7/1962 | Denegre | 273/200 A |
| 3,086,775 | 4/1963 | Albert | 273/200 A |
| 3,143,351 | 8/1964 | Bertrand | 273/184 B |
| 3,754,761 | 8/1973 | Pruss | 273/200 A |
| 3,924,855 | 12/1975 | Pretorius | 273/26 EA X |
| 3,953,028 | 4/1976 | Gowins | 273/26 EA |
| 4,944,513 | 7/1990 | Zentner | 273/26 EA X |
| 5,286,028 | 2/1994 | Daugard | 273/200 A X |

*Primary Examiner*—Raleigh W. Chiu

[57] ABSTRACT

A device for use in hitting golf shots when in a confined space comprising a first inverted u-shaped member having parallel legs and a linear cross leg coupling the upper ends of the parallel legs. A second inverted u-shaped member has parallel legs and a linear cross leg coupling the upper ends of the parallel legs. A main cable couples the horizontal legs of the large inverted u-shaped member and the small inverted u-shaped member at a higher elevation. An attachment devices is securely coupled to each inverted u-shaped member to the ground at a distance to maintain the main cable in a taut orientation. Lastly, a hollow cylindrical sleeve secured about the main cable and traveling along the length thereof, the sleeve having a supplemental string coupled at its upper end to the sleeve and at its lower end to a golf ball to be hit.

7 Claims, 4 Drawing Sheets

DEVICES FOR HITTING GOLF BALLS WHEN IN CONFINED SPACES

BACKGROUND OF THE INVENTION

1. Field of the Invention

The present invention relates to devices for hitting golf balls when in confined spaces and more particularly pertains to hitting full golf shots in confined spaces with a golf ball restraining system.

2. Description of the Prior Art

The use of golfing aids is known in the prior art. More specifically, golfing aids heretofore devised and utilized for the purpose of practicing golf shots are known to consist basically of familiar, expected, and obvious structural configurations, notwithstanding the myriad of designs encompassed by the crowded prior art which has been developed for the fulfillment of countless objectives and requirements.

A large number of golf training devices are disclosed in the prior art. By way of example, U.S. Pat. No. 4,014,553 to Sadamoto discloses a combined ball tether and anchor structure.

U.S. Pat. No. 4,660,835 to Locurto discloses a tethered ball golf practice device, U.S. Pat. No. 5,054,786 to Solomon discloses a tethered golf ball, U.S. Pat. No. 5,108,107 to Shelton discloses a practice device for golfers.

U.S. Pat. No. 5,178,393 to Dennesen discloses a method and apparatus for measuring golf driving distance.

In this respect, devices for hitting golf balls when in confined spaces according to the present invention substantially depart from the conventional concepts and designs of the prior art, and in doing so provides an apparatus primarily developed for the purpose of hitting full golf shots in confined spaces with a golf ball restraining system.

Therefore, it can be appreciated that there exists a continuing need for new and improved devices for hitting golf balls when in confined spaces which can be used for hitting full golf shots in confined spaces with a golf ball restraining system. In this regard, the present invention substantially fulfills this need.

SUMMARY OF THE INVENTION

In view of the foregoing disadvantages inherent in the known types of golfing aids now present in the prior art, the present invention provides improved devices for hitting golf balls when in confined spaces. As such, the general purpose of the present invention, which will be described subsequently in greater detail, is to provide new and improved devices for hitting golf balls when in confined spaces and methods which have all the advantages of the prior art and none of the disadvantages.

To attain this, the present invention essentially comprises a new and improved device for use in hitting golf shots when in a confined space comprising, in combination, a first small inverted u-shaped member having parallel vertical legs and a linear horizontal cross leg coupling the upper ends of the parallel legs; a second large inverted u-shaped member having parallel vertical legs and a linear horizontal cross leg coupling the upper ends of the parallel legs; a main cable coupling the horizontal legs of the large inverted u-shaped member and the small inverted u-shaped member with the end of the cable attached to the large u-shaped member being at a higher elevation than the end of the cable attached to the smaller u-shaped member; attachment means in the form of a downwardly extending central spike co-axial with each vertical leg, each attachment means having an upwardly extending projection to be slidably received by the lower end of each vertical leg, and with a horizontally extending flange therebetween with apertures for receiving supplemental stakes to securely couple each inverted u-shaped member to the ground at a distance to maintain the main cable in a taut orientation; a hollow cylindrical sleeve secured about the main cable and traveling along the length thereof, the sleeve having a supplemental string coupled at its upper end to the sleeve and at its lower end to a golf ball to be hit; and a ball secured to the main cable at each end thereof adjacent to the associated horizontal leg of its associated u-shaped member to limit the path of travel of the golf ball.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved devices for hitting golf balls when in confined spaces which have all the advantages of the prior art golfing aids and none of the disadvantages.

It is another object of the present invention to provide new and improved devices for hitting golf balls when in confined spaces which may be easily and efficiently manufactured and marketed.

It is a further object of the present invention to provide new and improved devices for hitting golf balls when in confined spaces which are of a durable and reliable construction.

An even further object of the present invention is to provide new and improved devices for hitting golf balls when in confined spaces which are susceptible of a low cost of manufacture with regard to both materials and labor, and which accordingly are then susceptible of low prices of sale to the consuming public, thereby making such devices for hitting golf balls when in confined spaces economically available to the buying public.

Still yet another object of the present invention is to provide new and improved devices for hitting golf balls when in confined spaces which provide in the apparatuses and methods of the prior art some of the advantages thereof, while simultaneously overcoming some of the disadvantages normally associated therewith.

Lastly, it is an object of the present invention to provide a new and improved device for use in hitting golf shots when in a confined space comprising a first inverted u-shaped member having parallel legs and a linear cross leg coupling the upper ends of the parallel legs; a second inverted u-shaped member having parallel legs and a linear cross leg coupling the upper ends of the parallel legs; a main cable coupling the horizontal legs of the large inverted u-shaped member and the small inverted u-shaped member with the end of the cable attached to the large u-shaped member at a higher elevation; attachment means to securely couple each inverted u-shaped member to the ground at a distance to maintain the main cable in a taut orientation; and a hollow cylindrical sleeve secured about the main cable and traveling along the length thereof, the sleeve having a supplemental string coupled at its upper end to the sleeve and at its lower end to a golf ball to be hit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
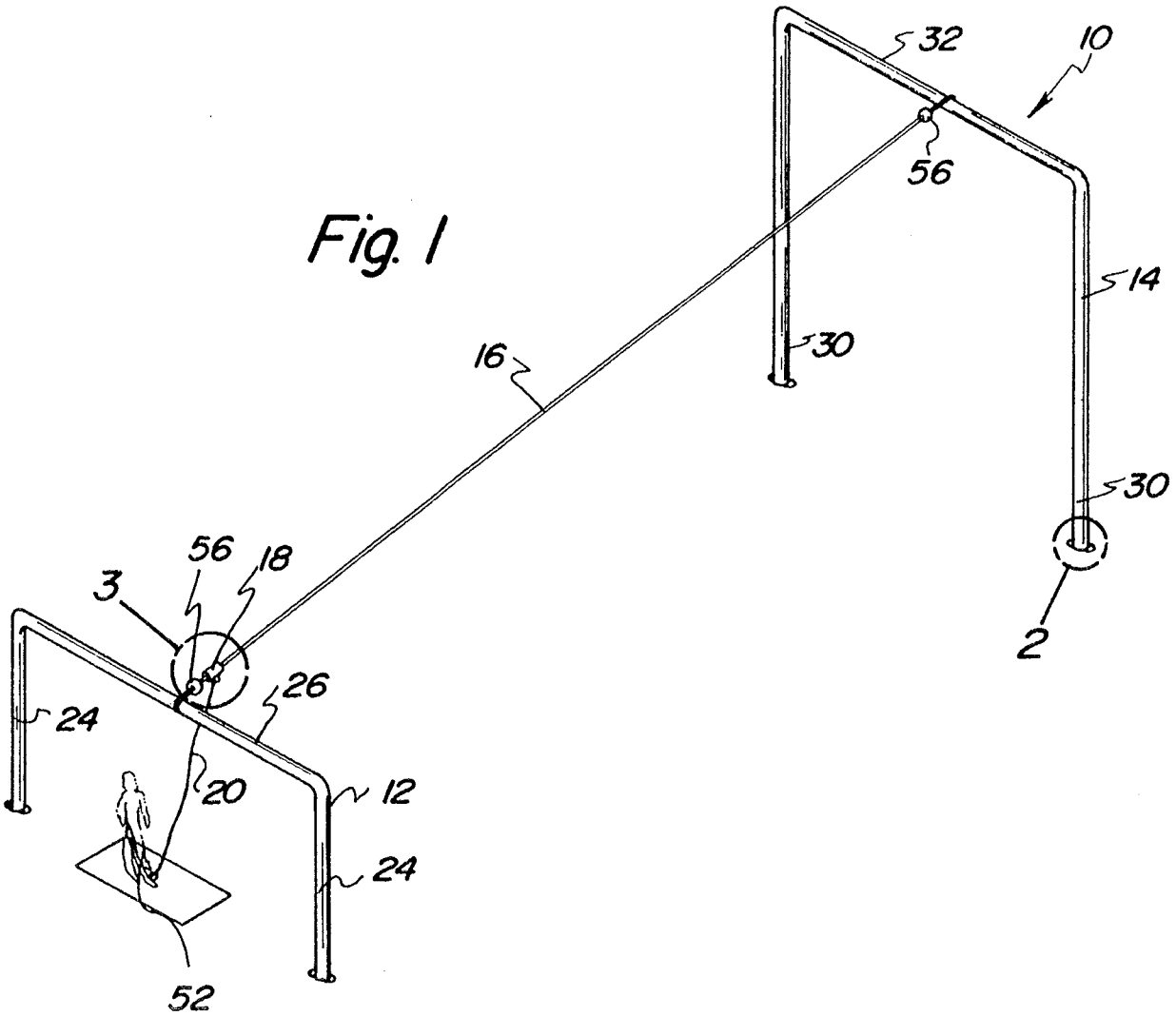
FIG. 1 is a perspective view of the preferred embodiment of the devices for hitting golf balls when in confined spaces constructed in accordance with the principles of the present invention.
Figure 2:
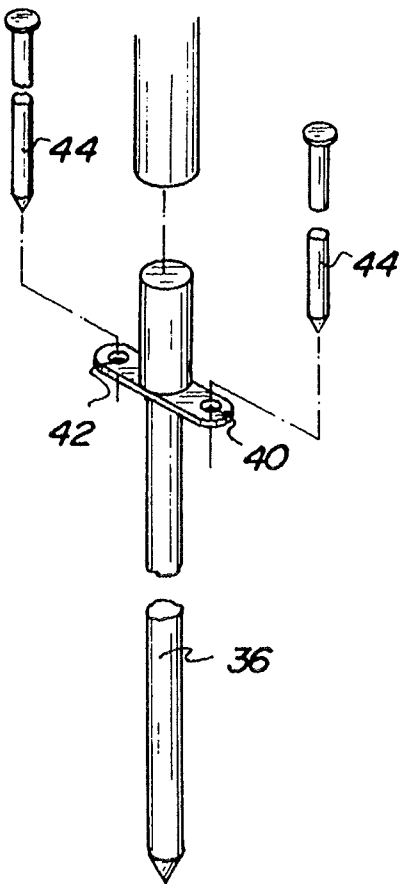
FIG. 2 is an enlarged perspective view of the mechanisms at the ends of the legs shown in the circled area of FIG. 1.
Figure 3:
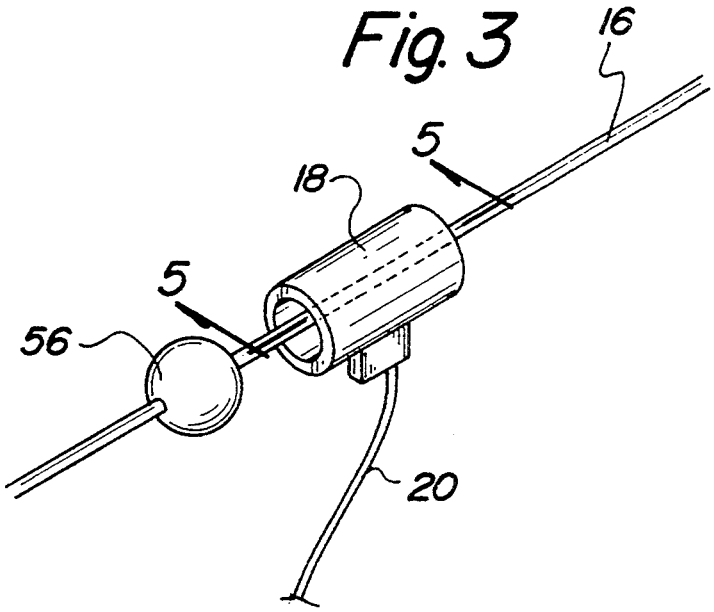
FIG. 3 is an enlarged perspective view of the sleeve coupled to the main cable taken at the circle of FIG. 1.
Figure 4:
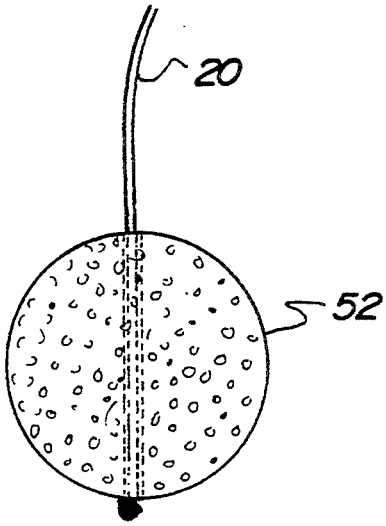
FIG. 4 is an enlarged illustration of the golf ball to be hit in its coupling to the supplemental strings.
Figure 5:
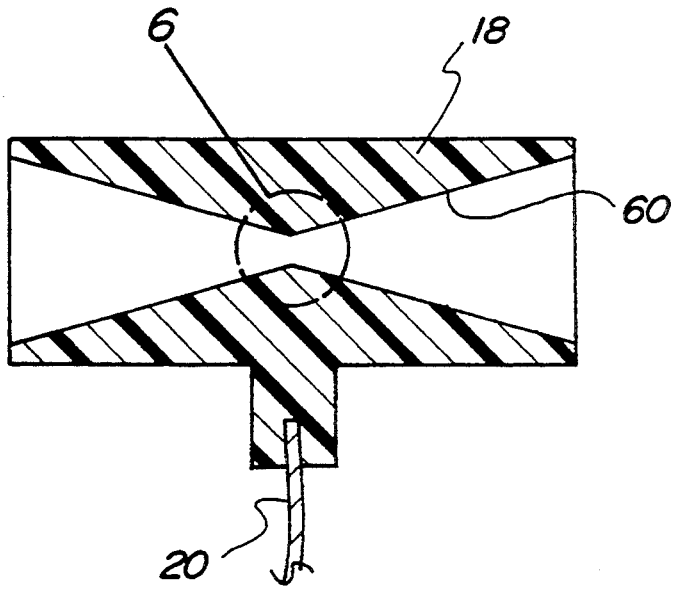
FIG. 5 is a sectional view of the sleeve taken along line 5—5 of FIG. 3.

With reference now to the drawings, and in particular to FIG. 1 thereof, the preferred embodiment of the new and improved devices for hitting golf balls when in confined spaces embodying the principles and concepts of the present invention and generally designated by the reference numeral 10 will be described.

More specifically, it will be noted in FIGS. 1 through 5 there is shown a device 10 for use in hitting golf shots when in a confined space. The device, in its simplest terms comprises a small inverted u-shaped member 12, a large inverted u-shaped member 14, a main cable 16 therebetween, a hollow sleeve 18 slidable along the cable and a string 20 coupling the sleeve and a golf ball to be hit.

More specifically, the first component of the device 10 is a first small inverted u-shaped member 12. It is formed with parallel vertical legs 24 and a horizontal linear cross leg 26 coupling the upper ends of the parallel legs 24.

Also provided is a second large inverted u-shaped member 14. It is formed with parallel vertical legs 30 and a linear horizontal cross leg 32 coupling the upper ends of the parallel legs 30. Both u-shaped members are fabricated of rigid tubes, plastic or metal. They may be formed of plural sections slidably matable with respect to each other for storage, transportation and ease of assembly and disassembly.

Coupling the centers of the horizontal cross legs 26 and 32 of the large inverted u-shaped member and the small inverted u-shaped member is the main cable 16. The end of the cable attached to the large u-shaped member is at a higher elevation than the end of the cable attached to the small u-shaped member.

Secure coupling of the u-shaped members to the ground is through attachment means in the form of a central spike 36. A spike is provided for each vertical leg of the u-shaped members. The spikes are co-axial with each vertical leg. An upward extension 38 extends upwardly from the spike and is slidably received within the lower end of each vertical leg. A horizontally extending flange 40 is formed with apertures 42 for receiving supplemental stakes 44 to securely couple the two inverted u-shaped members to the ground. Such coupling is at a distance to maintain the main cable in a taut orientation with one end higher than the other.

A hollow cylindrical sleeve 18 is next provided. The sleeve is secured about the main cable 16 for slidable traveling along the length thereof. The sleeve 18 has a supplemental string 48. The string is coupled at its upper end to the sleeve. At its lower end the string is coupled to a golf ball 52 to be hit. Coupling is by the string extending through a hole in the golf ball with the end of the string being knotted. Note FIG. 4. Hitting is from the smaller u-shaped member 12 so that after being hit, the ball and sleeve are adjacent to the larger u-shaped member 14. At such location, the sleeve 18 and golf ball 52 will slide by the action of gravity from the larger to the smaller u-shaped member.

A ball 56 is fixedly secured to the main cable at each end thereof adjacent to the associated horizontal leg of its associated u-shaped member. The function of ball 56 is to limit the path of travel of the sleeve 18 and hence the golf ball.

In the preferred embodiment of the invention, the interior surface 60 of the sleeve 18 is formed in the shape of a pair of facing frustrocones. This shape is to facilitate the movement of the sleeve 18 along the main cable 16.

Figure 6:
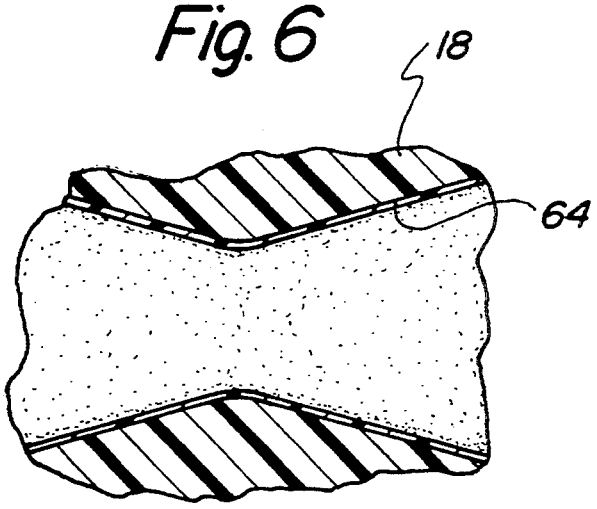
FIG. 6 is an enlarged sectional view of a portion of the sleeve constructed in accordance with an alternate embodiment of the invention.

An alternate embodiment of the invention is shown in FIG. 6. In such embodiment, a coating 64 of lubricous material is secured to the interior surface of the sleeve.

Figure 7:
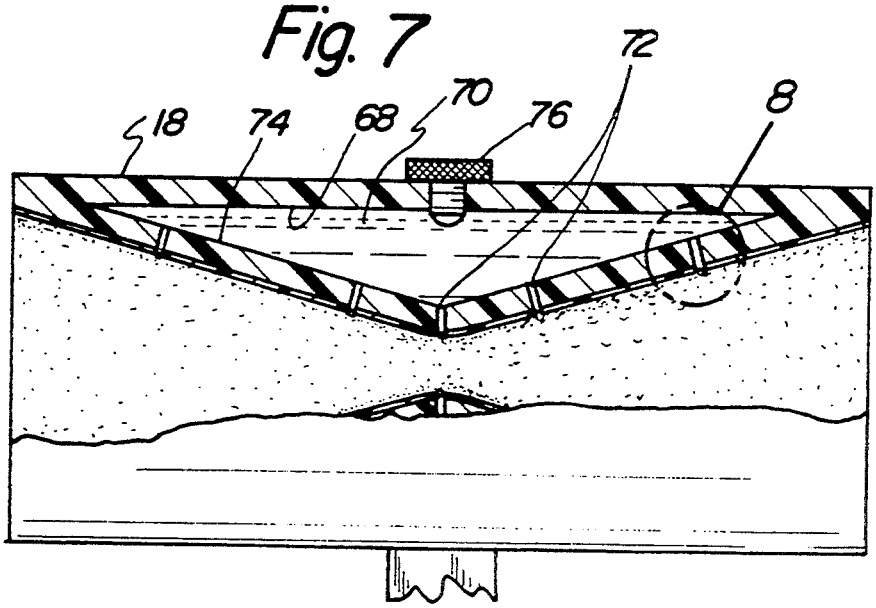
FIG. 7 is an enlarged view partly in section showing the sleeve constructed in accordance with another alternate embodiment of the invention.

FIG. 7 illustrates another alternate embodiment of the invention. In such embodiment, the space exterior of the opening in the sleeve is formed as a cavity 68 for the receipt of a lubricous fluid 70. Small apertures 72 are formed in the interior wall 74. Such apertures allow the flow of fluid from the chamber into contact with the main cable 16 for its lubrication. The cavity has a fill cap 76 associated therewith for replenishing the fluid from exterior of the sleeve.

Figure 8:
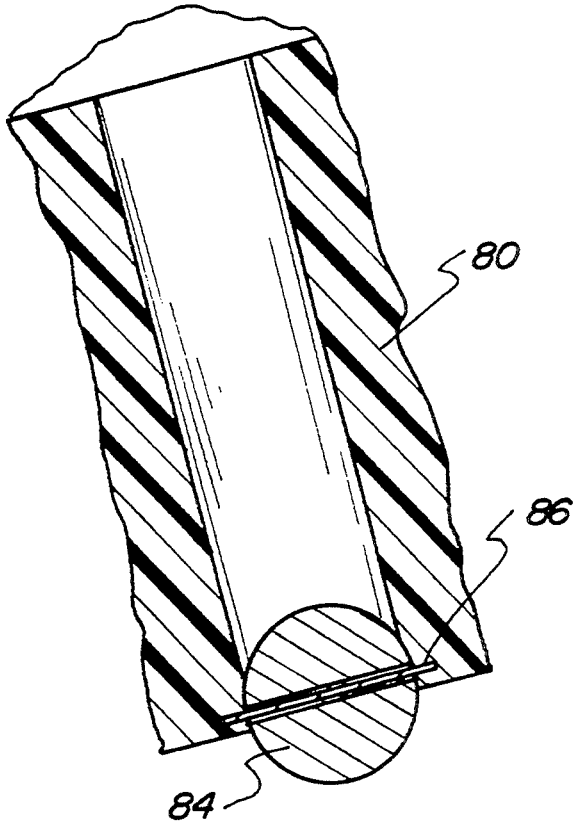
FIG. 8 is an enlarged view partly in section showing yet another alternate embodiment of the invention.

The final alternate embodiment of the invention is shown in FIG. 8. According to such embodiment, a canister 80 is provided. The canister is filled with a lubricant 82. A ball 84 rotatable about a pin 86 is in communication with the lubricant and exterior of the canister. Rolling the ball 84 on the cable 16 effects its lubrication to enhance performance.

The present invention provides the challenge of a driving range with the convenience of not having to retrieve the balls. This is because your ball will come back to you after you hit it. With this unique product, golfers can practice driving and experience the satisfaction of watching the ball soar away from them, and then watch their ball return automatically without lifting a finger.

The present invention utilizes a 110-foot string mounted roughly 10 feet high at the spot where the golfer is driving from, rising steadily to 25 feet in height at a distance of 100 feet from where the golfer stands. A hole is drilled through the center of a golf ball and a string is looped through it. This string is then connected to a sliding mechanism that glides along the mounted string.

When the golfer hits the ball, it behaves pretty much like an ordinary golf ball. Its flight is stopped after roughly 100 feet, of course, and the angle of the mounted string causes the ball to slide back down to the original starting point. The golfer can then hit another shot.

The present invention offers a way for golfers to practice their driving skills without going to a driving range. In addition, it is more satisfying than hitting balls into a net.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved device for use in hitting golf shots when in a confined space comprising, in combination:

a first small inverted u-shaped member having parallel vertical legs and a linear horizontal cross leg coupling the upper ends of the parallel legs;

a second large inverted u-shaped member having parallel vertical legs and a linear horizontal cross leg coupling the upper ends of the parallel legs;

a main cable coupling the horizontal legs of the large inverted u-shaped member and the small inverted u-shaped member with the end of the cable attached to the large u-shaped member being at a higher elevation than the end of the cable attached to the smaller u-shaped member;

attachment means in the form of a downwardly extending central spike co-axial with each vertical leg, each attachment means having an upwardly extending projection to be slidably received by the lower end of each vertical leg, and with a horizontally extending flange therebetween with apertures for receiving supplemental stakes to securely couple each inverted u-shaped member to the ground at a distance to maintain the main cable in a taut orientation;

a hollow cylindrical sleeve secured about the main cable and traveling along the length thereof, the sleeve having a golf ball to be hit and a supplemental string having an upper end coupled to the sleeve and a lower end coupled to the golf ball to be hit with the length of the string sufficient to extend between the sleeve and the golf ball; and a supplemental ball secured to the main cable at each end thereof adjacent to the associated horizontal leg of its associated u-shaped member to limit the path of travel of the golf ball.

2. A device for use in hitting golf shots when in a confined space comprising:

a first small inverted u-shaped member having parallel legs and a linear cross leg coupling the upper ends of the parallel legs;

a second large inverted u-shaped member having parallel legs and a linear cross leg coupling the upper ends of the parallel legs;

a main cable coupling the horizontal legs of the large inverted u-shaped member and the small inverted u-shaped member with the end of the cable attached to the large u-shaped member at a higher elevation;

attachment means to securely couple each inverted u-shaped member to the ground at a distance to maintain the main cable in a taut orientation; and a hollow cylindrical sleeve secured about the main cable and traveling along the length thereof, the sleeve having a golf ball to be hit and a supplemental string coupled at its upper end to the sleeve and at its lower end to the golf ball to be hit, the string being of a length to extend between the golf ball on the ground and the sleeve when adjacent to its small inverted u-shaped member.

3. The device as set forth in claim 2 and further including a ball secured to the main cable at each end thereof adjacent to the associated horizontal leg of its associated u-shaped member to limit the path of travel of the golf ball.

4. The device as set forth in claim 2 wherein the interior surface of the sleeve is formed in the shape of a pair of facing frustrocones to facilitate the movement of the sleeve along the main cable.

5. The device as set forth in claim 2 and further including a coating of lubricous material formed on the interior surface of the sleeve.

6. The device as set forth in claim 2 wherein the space exterior of the opening through the sleeve is formed as a cavity for the receipt of a lubricous fluid and with small apertures thereadjacent to allow the flow of fluid therefrom into contact with the main cable, the cavity having a fill cap associated therewith for replenishing the fluid.

7. The device as set forth in claim 2 and further including a canister with a lubricant and with a rotatable ball in communication with the fluid and the exterior of the canister for lubricating the main cable.

* * * * *